US008439009B2

(12) United States Patent
Throop et al.

(10) Patent No.: US 8,439,009 B2
(45) Date of Patent: May 14, 2013

(54) WATER REDUCTION MECHANISM FOR AN INTERNAL COMBUSTION ENGINE

(75) Inventors: Medville Jay Throop, Ann Arbor, MI (US); Adam Denlinger, Saline, MI (US); Amiyo K Basu, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/350,209

(22) Filed: Jan. 13, 2012

(65) Prior Publication Data

US 2012/0111289 A1 May 10, 2012

Related U.S. Application Data

(63) Continuation of application No. 12/122,901, filed on May 19, 2008, now Pat. No. 8,104,449.

(51) Int. Cl.
*F01M 1/02* (2006.01)

(52) U.S. Cl.
USPC ..... 123/196 R; 123/41.86; 123/196 A

(58) Field of Classification Search ..... 123/196 R, 123/196 AB, 196 A, 41.01, 41.33, 537, 572, 123/573, 3; 184/6.22; 210/167.01, 167.02, 210/167.06
See application file for complete search history.

(56) References Cited

U.S. PATENT DOCUMENTS

| | | | | |
|---|---|---|---|---|
| 3,996,912 | A | 12/1976 | Dreisin et al. | |
| 4,458,634 | A | 7/1984 | Carr et al. | |
| 4,463,566 | A * | 8/1984 | Guidoboni et al. | 60/605.1 |
| 4,722,309 | A * | 2/1988 | Guidoboni et al. | 123/251 |
| 4,822,309 | A * | 4/1989 | Vandenberg | 441/35 |
| 5,239,913 | A | 8/1993 | Terauchi | |
| 6,053,143 | A | 4/2000 | Taylor | |
| 6,182,616 | B1 | 2/2001 | Itoh et al. | |
| 6,421,588 | B1 | 7/2002 | Janata | |
| 6,513,368 | B2 | 2/2003 | Bondarowicz et al. | |
| 6,513,463 | B2 * | 2/2003 | Katayama | 123/41.29 |
| 6,535,001 | B1 | 3/2003 | Wang | |
| 7,121,248 | B2 | 10/2006 | Fukuda et al. | |
| 2002/0050251 | A1 | 5/2002 | Takahashi et al. | |
| 2002/0112679 | A1 | 8/2002 | Langervik | |
| 2002/0129789 | A1 * | 9/2002 | Furukawa et al. | 123/378 |
| 2006/0070600 | A1 | 4/2006 | Hara | |
| 2007/0056534 | A1 * | 3/2007 | Verstallen | 123/25 A |
| 2007/0131193 | A1 | 6/2007 | Takahashi | |
| 2007/0156322 | A1 | 7/2007 | Soga et al. | |
| 2008/0035099 | A1 * | 2/2008 | Yamashita et al. | 123/196 R |
| 2008/0072858 | A1 * | 3/2008 | Chang | 123/1 A |
| 2008/0302342 | A1 * | 12/2008 | Jiang | 123/536 |
| 2009/0071435 | A1 * | 3/2009 | Yamashita et al. | 123/196 R |

(Continued)

FOREIGN PATENT DOCUMENTS

| | | |
|---|---|---|
| GB | 2272298 A | 5/1994 |
| JP | 61190106 | 8/1986 |

*Primary Examiner* — Noah Kamen
*Assistant Examiner* — Long T Tran
(74) *Attorney, Agent, or Firm* — Julia Voutyras; Alleman Hall McCoy Russell & Tuttle LLP

(57) ABSTRACT

A system for an engine includes an engine block having a cylinder, an oil delivery system including an oil reservoir at least partially enclosing an oil emulsion and providing lubricating oil to at least one cylinder, and a controller configured to adjust the heat delivered to the engine via a heat adjustment mechanism in response to a concentration of water in the oil emulsion.

19 Claims, 3 Drawing Sheets

U.S. PATENT DOCUMENTS

2009/0188476 A1 7/2009 Sasajima et al.
2009/0194043 A1 8/2009 Goj
2010/0018805 A1* 1/2010 Sachdev et al. ..... 184/6.3
2010/0263623 A1* 10/2010 Sakurai et al. ..... 123/25 J
2011/0030658 A1* 2/2011 Ulrey et al. ..... 123/521

* cited by examiner

WATER REDUCTION MECHANISM FOR AN INTERNAL COMBUSTION ENGINE

CROSS REFERENCE TO RELATED APPLICATIONS

The present application is a continuation of U.S. patent application Ser. No. 12/122,901 filed May 19, 2008, the entire contents of which are incorporated herein by reference for all purposes.

BACKGROUND/SUMMARY

Internal combustion engines utilize oil for various functions, including lubrication, cooling, etc. The oil can be circulated through various engine passages from a common reservoir, such as an oil pan. Degradation of the engine oil may occur for a variety of reasons such as due to water build-up in the oil and so on. For example, water formed as a byproduct of combustion can condense and migrate into the engine oil. Additionally, engines combusting hydrogen fuel, for example, can produce significantly more water than engines combusting gasoline.

Excessive water build-up can degrade the oil and thus lead to increased engine component wear. In turn, increased component wear may increase degradation rates of various engine components, such as bearings, piston rings, intake valves, camshafts, etc. Increased water in the oil may also lead to oil starvation caused by ice forming over an oil pickup tube. As another example, oil starvation may be caused by the oil-water mixture viscosity becoming too low to support oil pump operation.

One method to address oil degradation in a gasoline engine is discussed in U.S. Pat. No. 6,535,001. A sensor coupled to an oil pan determines when oil degradation occurs. A method is described, which among other things, determines if the oil in the oil pan has become contaminated with water and/or anti-freeze. If it is determined that the oil has become contaminated, the driver is alerted of "high water content" via a warning light located on the dashboard. After the warning light is illuminated, the driver is expected to operate the vehicle for an extended period of time to reduce the water and/or anti-freeze in the oil pan.

The inventors herein have recognized several disadvantages with the above approach. For example, the above system relies on actions initiated by the driver to address oil contamination. However, the operator may be unwilling, or unable, to provide the requested operation. For example, the operator may be unwilling to consume additional fuel to provide the requested operation. As another example, the operator may have other scheduled activities to carry out, or the operator may be stuck in traffic. Finally, in hydrogen-fuelled engines, because of the large volume of water by-products produced, simply extending driving operation of the vehicle may exacerbate the water contamination of the oil rather than reduce it.

As such, in one approach, a system for an internal combustion engine including an engine block having a cylinder, an oil delivery system coupled to the engine block including an oil reservoir at least partially enclosing an oil emulsion, the oil delivery system providing lubricating oil to at least one cylinder in the engine, a heat adjustment mechanism coupled to the engine, and a controller configured to adjust the heat delivered to the engine, via the heat adjustment mechanism, in response to an indication of water in the oil emulsion. For example, water concentration in the emulsion may provide such an indication. However, other indications, such as emulsion viscosity, may also be used.

In this way, by increasing the temperature of the engine, and thus the oil, it may be possible to evaporate the condensed water in the oil and thereby remove water from the oil, decreasing oil degradation. Additionally, or alternatively, it may be possible to reduce ice formation that may block an oil pick-up tube. Likewise, it may be possible to reduce oil viscosity to maintain system operation. In one example, the oil temperature may be increased via a block heater, such as used for improving cold starting in cold climates. In another example, the oil temperature may be increased by adjusting the engine cooling system. In still another example, the oil temperature may be increased by an oil heater in the oil pan. Still other examples are also possible as described herein.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Hydrogen fuel may be used in internal combustion engines. Due to the characteristics of the hydrogen combustion process, an increased amount of water may be generated as a by-product of combustion during operation of the engine. The water may then condense and migrate into the engine oil. The systems and methods, described herein, show various examples of reducing water contamination of engine oil by increased temperature of the engine and/or oil to thereby evaporate the water and pass it into the intake manifold, for example.

In some examples, the engine disclosed herein may use hydrogen as its primary fuel source. In other examples, the engine may use various mixtures of hydrogen and another fuel, such as gasoline. However, various other fuels may be used, such as other fuels that may produce increased water condensate in the engine oil.

Figure 1:
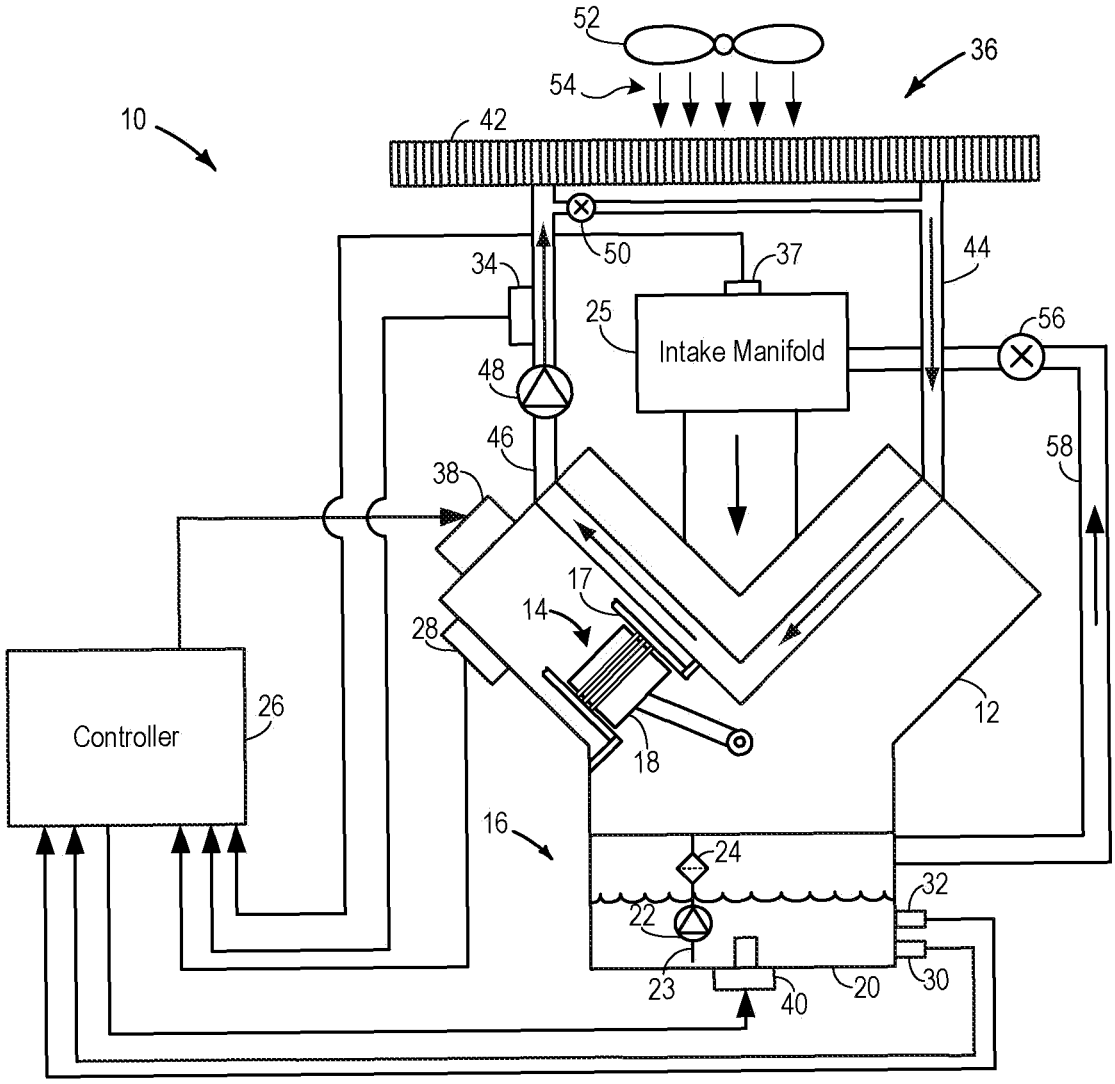
FIG. 1 shows a schematic depiction of an internal combustion engine including an oil delivery system, engine cooling system, and associated controller.

FIG. 1 shows a schematic diagram of an internal combustion engine 10 which may be included in a propulsion system of a vehicle. The internal combustion engine includes an engine block 12 having at least one combustion chamber 14, coupled to an oil delivery system 16. Combustion chamber (e.g., cylinder) 14 of engine 10 may include combustion chamber walls 17 with piston 18 positioned therein. The engine further includes an intake manifold 25 fluidly coupled to the cylinders, allowing air to be provided to the cylinders for combustion. A fuel delivery system (not shown) may be configured to delivery fuel to the cylinder.

The oil delivery system 16 includes an oil reservoir 20, a pump 22, a pick up tube 23, and a filter 24. The oil delivery system delivers lubricating oil via the pump to the bearings and other components, including the cylinder, decreasing the wear on the pistons and the cylinders during operation of the engine. The oil reservoir may at least partially enclose an oil emulsion which may include lubricating oil and various contaminants, such as water and/or engine coolant.

A variety of sensors capable of determining various operating conditions of the engine and the oil delivery system may be coupled to the engine and a controller 26. In particular, the various sensors may include an engine block temperature sensor 28 coupled to the engine block, an oil reservoir composition sensor 30 coupled to the oil reservoir, an oil reservoir temperature sensor 32 coupled to the oil reservoir, an engine coolant temperature sensor 34 coupled to an engine cooling system 36, an ambient temperature sensor (not shown) coupled to the engine, an engine and/or an intake manifold temperature sensor 37 coupled to the intake manifold. The controller is configured to determine the operating conditions measured by the sensors. The oil reservoir composition sensor is configured to determine the concentration of a least one substance in the oil emulsion, such as a water concentration, for example.

It can be appreciated that other suitable temperature and composition sensors may be coupled to other suitable locations in the engine. Further, other sensors may be used to indicate water in the oil emulsion, such as a viscosity sensor to sense viscosity of the emulsion. Moreover, a number of heat adjustment mechanisms, such as heaters and the engine cooling system, may be coupled to the engine, such as the engine block and/or the oil delivery system. Specifically, the heaters may include an engine block heater 38 and an oil reservoir heater 40. The oil reservoir heater may be a surface heater or a submersion heater. In some examples, the surface heater may be configured to float on the surface of the oil emulsion. Furthermore, the cooling system may include a radiator 42 fluidly coupled to various conduits capable of circulating engine coolant (e.g. anti-freeze) in the engine block allowing heat to be drawn away from the engine. The conduits may include a first conduit 44 and a second conduit 46. The heaters and the engine cooling system may be operated to adjust the temperature of the engine and associated components.

The engine cooling system may further include a cooling system pump 48, a radiator bypass valve 50, and a radiator fan 52. Controller 26 may adjust the cooling system pump to adjust the flowrate (and thus heating/cooling) of the engine coolant through the engine cooling system. Controller 26 may further adjust the bypass valve and fan. The bypass valve is configured to adjust the amount of engine coolant flowing through the radiator, decreasing the amount of cooling the system can provide. The radiator fan is configured to direct cooling air 54 at the radiator, increasing the amount of heat dissipated by the engine cooling system.

Under some operating conditions the engine cooling system may be adjusted to increase the temperature of the engine block and therefore the oil reservoir. In particular, the coolant flow may be reduced by adjusting pump operation and/or adjusting the bypass valve, and the radiator fan may be adjusted to reduce the amount of cooling air provided to the radiator.

Continuing with FIG. 1, a Positive Crankcase Ventilation PCV valve 56 may be fluidly coupled to the oil reservoir 20 and an intake manifold 25 via a conduit 58. Under some operating conditions the PCV valve may be opened, allowing humid air to be drawn out of the crankcase and vented into the intake manifold, increasing the rate of water evaporation in the oil emulsion, and decreasing the chance of oil degradation due to high water content. Furthermore, the controller may operate the heat adjustment mechanisms and sensors in such a way to provide feedback temperature control of the engine, discussed in more detail herein.

As noted herein, during operating of the engine, while fuel is being combusted in the combustion chamber, water generated in the combustion process may travel from the combustion chamber to the oil reservoir creating an oil emulsion. In some cases, the oil emulsion may contain too much water and/or engine coolant to properly lubricate the engine. Furthermore, under some conditions, the viscosity of the oil emulsion may become too high, which in turn may lead to increased component wear and increased degradation rates. Further still, the water in the oil emulsion may freeze which may damage the conduits and/or pump included in the oil delivery system, as well as block the oil pick-up tube thereby starving the engine of lubricating oil.

Figure 4:
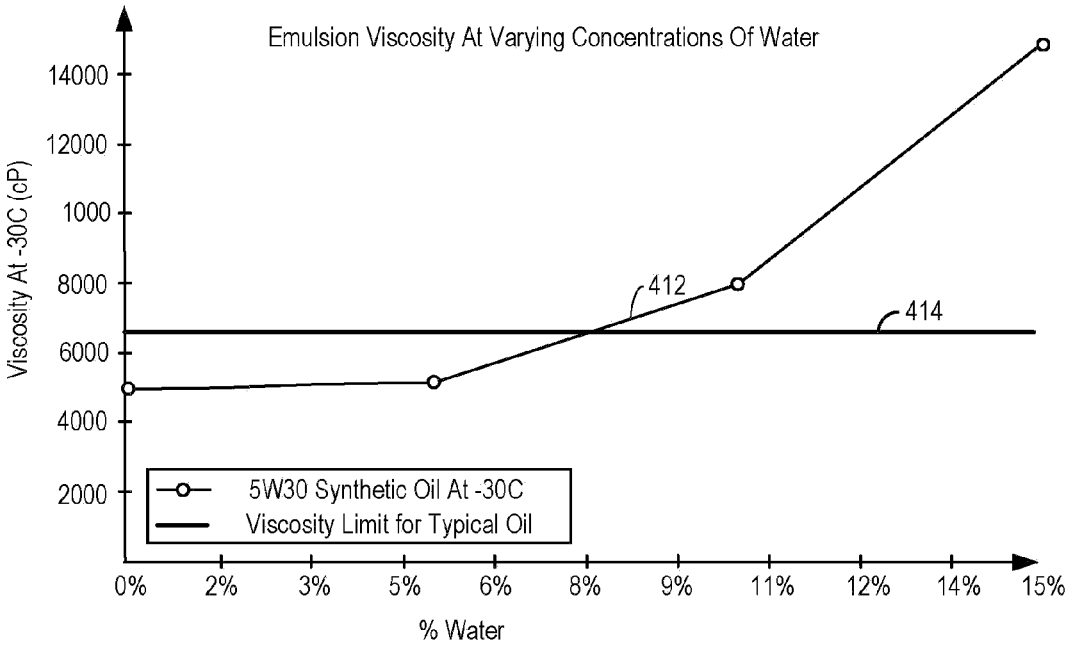
FIG. 4 shows a graphical depiction of the oil emulsion's viscosity as the concentration of water in the emulsion increases.

A graphical representation of the oil emulsion viscosity in the oil reservoir vs. the concentration of water in the oil emulsion at −30 degrees Celsius is shown in FIG. 4. Line 412 represents the viscosity of the oil. In this example a 5W30 synthetic oil is used. In other examples, alternate suitable lubricating oils may be utilized. Line 414 represents the maximum viscosity at which the oil pump can operate. At cold temperatures (e.g. −30 degrees Celsius) the viscosity of the emulsion increases as the concentration of water in the emulsion increases. Under some conditions, increased water concentration in the oil emulsion may lead to an increase in oil emulsion viscosity above the maximum viscosity at which the pump and/or oil delivery system can operate, rendering the oil delivery system inoperable. An inoperable pump may decrease the performance of the engine. In this example, the maximum viscosity at which the oil delivery system can operate is 6300 Centipoise cP. In other examples, the maximum viscosity at which the oil delivery system can operate may be higher or lower than the above example.

Figure 2:
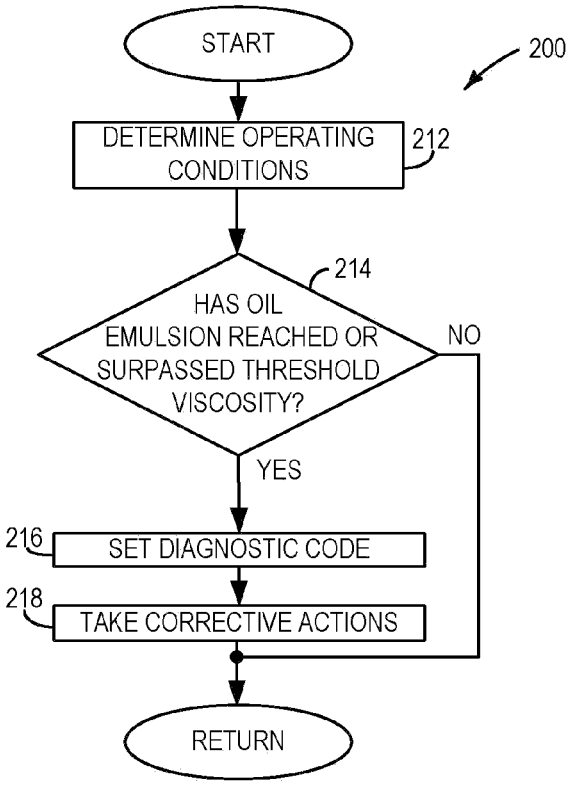
FIG. 2 shows a control method that may be implemented to decrease the amount of water contained in the oil delivery system, shown in FIG. 1.
Figure 3:
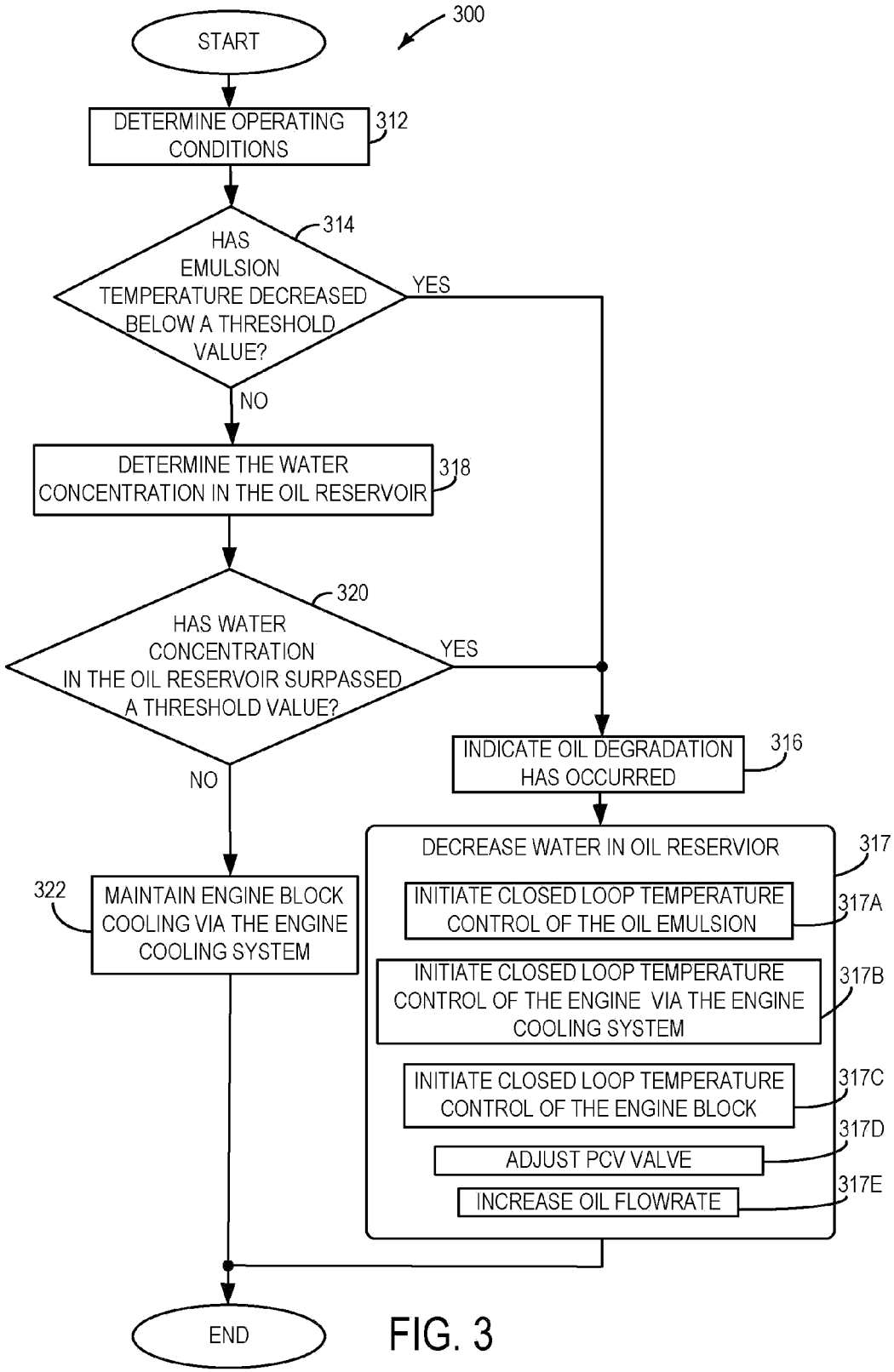
FIG. 3 shows an additional control method that may be implemented to decrease the amount of water contained in the oil delivery system, shown in FIG. 1.

FIG. 2 and FIG. 3 illustrate various control strategies to address oil degradation, such as due to oxidation, depletion of additives, contamination, etc. In one example, the control strategies address water condensation in the oil emulsion, such as using the information of FIG. 4. In particular, FIG. 2 and FIG. 3 illustrate control strategies which may assist in the removal of water from the oil emulsion, inhibit the oil emulsion's temperature from reaching or falling below a threshold value, and/or inhibiting the water concentration in the oil emulsion from surpassing a threshold value. In some examples, the methods discussed herein may be implemented prior to engine start up. Further, note that various approaches may be used as an indication of water in the engine oil. For example, the indication may be based on water concentration in the emulsion, a viscosity of the emulsion, and/or a temperature of the emulsion. In another example, the indication of oil contamination may be based on an increase in oil level, e.g., due to the addition of condensate in the emulsion.

Referring now to FIG. 2, it shows a high level flow chart, method 200, which may be implemented to decrease the oil emulsion viscosity of the oil located in the oil reservoir.

At 212 the operating conditions of the engine are determined. The operating conditions may include: intake temperature, engine temperature, engine coolant temperature, emulsion composition, engine speed, and various others. The aforementioned operating conditions may be determined by intake manifold temperature sensor 37, engine coolant temperature sensor 34, oil reservoir composition sensor 30, and/or oil emulsion temperature sensor 32.

The method then advances to 214, where it is determined if the viscosity of the oil emulsion has surpassed a threshold value. In some examples, the viscosity may be directly correlated to the temperature of the oil emulsion, the ambient temperature, oil emulsion composition, and/or the engine temperature. If it is determined that the viscosity has not surpassed the threshold value, the method returns to the start, or ends.

However, if it is determined that the viscosity has surpassed a threshold value, the method advances to 216, where a diagnostic code is set. In some examples the diagnostic code is set by controller 26 and sent on a Controller Area Network CAN so that the code can be accessed by a universal code reader.

Next, the method advances to 218, where corrective actions are taken to reduce the water condensation in the oil and/or reduce freezing of the oil emulsion and/or increase temperature of the oil emulsion. The corrective actions may include: increasing oil temperature by activating the oil reservoir heater, activating the engine block heater, decreasing or inhibiting circulation of engine coolant via the engine cooling system, and/or decreasing cooling of the engine coolant via the radiator fan or coolant flow path. Further still, the method may increase/decrease crankcase ventilation via adjustment of the PCV valve 56.

In this way, the oil temperature may be increased to evaporate water in the emulsion and/or reduce freezing of the emulsion, along with various other corrective actions as noted herein.

FIG. 3 shows an additional embodiment, via method 300, that may be implemented to address water condensation in the engine oil.

At 312 the operating conditions of the system are determined, including: engine temperature, composition of oil emulsion, water concentration in the oil reservoir, temperature of the oil reservoir, ambient temperature, etc.

The method then advances to 314, where it is determined if the temperature of the oil emulsion in the oil reservoir is below a threshold value. In other examples, it may be determined if the ambient temperature and/or engine temperature is approaching a threshold value. If it is determined that the temperature of the oil emulsion in the oil reservoir is below a threshold value the method proceeds to 316, where oil degradation is indicated and sent on the CAN so that the code can be accessed by a universal code reader.

The method then advances to 317, where actions are taken to decrease the water in the oil reservoir and/or increase the oil temperature. The aforementioned actions may include at 317A, initiating closed loop temperature control of the oil emulsion temperature via the oil reservoir heater 40 and the oil reservoir temperature sensor 32 to increase the oil temperature. For example, the controller may calculate a reference temperature based on various operating conditions. The operating conditions may include ambient temperature, oil emulsion composition, etc. The oil reservoir heater may then be operated to increase the oil temperature until the oil emulsion has reached the reference temperature.

Additionally or alternatively, at 317B, closed loop temperature control of the engine via the engine cooling system may be implemented to increase the oil temperature. In particular, the operation of the cooling system pump 48 may be reduced, the radiator bypass valve 50 may be adjusted to increase the bypass flow, and/or the radiator fan 52 operation may be adjusted to reduce the amount of cooling air 54 provided to the radiator. In this way feedback temperature control of the engine is implemented by controller 26 to increase the temperature of the oil. Additionally or alternatively at 317C, closed loop temperature control of the engine block may be implemented to increase the temperature of the oil. In this way the temperature of the engine block may be increased to reduce condensation in the oil reservoir. In some examples, the engine block temperature sensor 28 and the engine block heater 38 may be used to perform feedback temperature control. Yet in other examples, the engine block temperature may be correlated to the oil emulsion temperature. In this way feedback temperature control of the oil emulsion may be implemented by the controller via the engine block temperature sensor and the engine block heater. The aforementioned feedback control systems may be implemented concurrently to heat the oil reservoir and increase evaporation. It can be appreciated that additional or alternate control strategies may be implemented via controller 26 to increase the temperature of the oil.

Furthermore, at 317D, PCV valve 56 may be adjusted to increase the amount of air vented from the crankcase. In this way humid air may be drawn away from the crankcase and oil reservoir allowing the rate of evaporation of water in the oil emulsion to increase. In some examples closed loop control of the PCV valve may be implemented. Additionally or alternatively, the flowrate of the oil through the oil delivery system may be increased, at 317E, via pump 22 to increase the mixing in the oil reservoir as well as increase the evaporation rate of the water in the oil reservoir. In this way pump 22 may be adjusted in response to a concentration of water in the oil emulsion and/or a temperature of the engine. After 317 the method ends.

However, if it is determined that the temperature of the oil emulsion in the reservoir is not below a threshold value the method advances to 318, where water concentration in the oil reservoir is determined. In some examples, the water concentration in the oil reservoir may be measured by oil reservoir composition sensor 30. In other examples, the concentration of water in the oil reservoir may be calculated.

Next the method proceeds to 320, where it is determined if the water concentration in the oil reservoir has surpassed a threshold value. If it is determined that the water in the oil reservoir has surpassed a threshold value the method will proceed to 316.

However, if it is determined that the water concentration in the oil reservoir has not surpassed a threshold value the method advances to 322 where engine cooling is maintained via the engine cooling system. Maintaining engine cooling may include operating the cooling system pump 48, operating the radiator fan 52, and/or adjusting the flow through the radiator bypass valve 50 to maintain a desired engine coolant temperature, which may be below a temperature used when the oil temperature falls below the threshold value of 314 or when the water concentration in the oil surpasses the threshold value of 320. After 322 the method ends, or returns to the start.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for an engine comprising:

an engine block having a cylinder;

an oil delivery system coupled to the engine block including an oil reservoir enclosing an oil emulsion, the oil delivery system providing lubricating oil to the cylinder;

a block heater coupled to the engine block; and a controller configured to adjust heat delivered to the engine, via the block heater, in response to a water indication in the oil emulsion.

2. The system of claim 1 further comprising a hydrogen fuel system fluidly coupled to the engine, and where the water indication includes a concentration of water in the oil emulsion.

3. The system of claim 1, wherein the block heater supplies heat delivered to oil in the oil delivery system.

4. The system of claim 3, wherein the controller is further configured to adjust the block heater in response to an oil reservoir temperature.

5. The system of claim 1, wherein the controller is further configured to adjust oil emulsion temperature via the block heater.

6. The system of claim 4, wherein the controller is further configured to increase evaporation of water via the block heater.

7. The system of claim 4, wherein adjusting heat delivered to the engine includes increasing engine oil temperature.

8. The system of claim 1, wherein the water indication includes an increased oil level.

9. The system of claim 1, wherein the controller is further configured to adjust the heat delivered to the engine prior to engine start up, and where the water indication includes a viscosity of the oil emulsion.

10. The system of claim 9, wherein the controller is further configured to adjust the heat delivered to the engine in response to an increase in oil emulsion viscosity above a threshold viscosity.

11. The system of claim 1, further comprising a pump coupled to the oil reservoir capable of delivering fluid from the oil reservoir to the cylinder, wherein the controller is further configured to adjust the pump in response to a concentration of water in the oil emulsion and/or an oil emulsion temperature.

12. A method for controlling an engine including a block heater configured to heat the engine and engine oil, comprising:

applying the block heater for improving cold starting in cold climates;

adjusting heat delivered by the block heater in response to a concentration of water in an oil emulsion during a first condition; and adjusting the heat delivered by the block heater in response to an operating temperature during a second condition.

13. The method of claim 12, wherein the first condition includes a higher concentration of water in the oil emulsion than the second condition, where the operating temperature includes engine coolant temperature.

14. The method of claim 12, wherein the heat delivered by the block heater is increased when the concentration of water is greater than a threshold.

15. The method of claim 12, wherein the concentration of water is determined by an oil reservoir composition sensor positioned in an oil reservoir of the engine.

16. The method of claim 12, further comprising combusting hydrogen fuel in the engine.

17. A system for an internal combustion engine comprising:

an engine block having a cylinder;

an oil delivery system coupled to the engine block including an oil reservoir at least partially enclosing an oil emulsion, the oil delivery system providing lubricating oil to at least one cylinder in the engine and including an oil pick-up tube;

a positive crankcase ventilation system configured to vent gasses from the oil reservoir to an intake of the engine;

an engine block heater coupled to the engine; and a controller configured to adjust heat delivered to the engine, via the block heater, in response to a concentration of water in the oil emulsion, the controller increasing temperature as the concentration increases.

18. The system of claim 17, further comprising a hydrogen fuel system configured to deliver hydrogen fuel to the cylinder, wherein the block heater is further adjusted responsive to engine coolant temperature.

19. The system of claim 17, wherein the heat delivered to the engine is adjusted in response to an ambient temperature.

* * * * *